United States Patent [19]

Shirahata et al.

[11] Patent Number: 4,469,718

[45] Date of Patent: Sep. 4, 1984

[54] PROCESS FOR MANUFACTURING POLYESTER RESIN INSULATED WIRES

[75] Inventors: Isao Shirahata, Chigasaki; Nobuyuki Nakamura, Fujisawa; Shigeharu Shioya, Hiratsuka; Hisako Hori, Tokyo, all of Japan

[73] Assignee: The Furukawa Electric Co., Ltd., Tokyo, Japan

[21] Appl. No.: 414,667

[22] Filed: Sep. 3, 1982

Related U.S. Application Data

[63] Continuation of Ser. No. 204,474, Nov. 6, 1980, abandoned.

[30] Foreign Application Priority Data

Nov. 14, 1979 [JP] Japan ..... 54-147227

[51] Int. Cl.[3] ..... H01B 7/00

[52] U.S. Cl. ..... 427/120; 427/377; 427/388.2; 428/379; 528/272; 528/308.8

[58] Field of Search ..... 427/32, 120, 195, 388.2, 427/377; 428/379; 528/272, 309, 308.8; 525/438, 445; 264/174; 174/110 SR, 110 PM

[56] References Cited

U.S. PATENT DOCUMENTS

| | | | |
|---|---|---|---|
| 2,388,319 | 11/1945 | Fuller | 427/122 |
| 2,921,873 | 1/1960 | Rogers | 428/379 |
| 3,579,379 | 5/1971 | Van Berkel et al. | 427/120 |
| 3,655,820 | 4/1972 | Kaupp | 525/445 |
| 3,853,817 | 12/1974 | Weddleton | 427/32 |
| 4,038,339 | 7/1977 | Foster | 525/445 |
| 4,104,416 | 8/1978 | Parthasarathy et al. | 427/32 |
| 4,146,703 | 3/1979 | Schmidt et al. | 525/445 |
| 4,269,947 | 5/1981 | Inata et al. | 525/445 |
| 4,307,153 | 12/1981 | Bernelin et al. | 525/438 |

FOREIGN PATENT DOCUMENTS 1263022 2/1972 United Kingdom .

*Primary Examiner*—Norman Morgenstern
*Assistant Examiner*—Richard Bueker
*Attorney, Agent, or Firm*—Frishauf, Holtz, Goodman & Woodward

[57] ABSTRACT

A process for manufacturing a polyester resin insulated wire involves coating a resin consisting essentially of a saturated substantially linear polyester prepared by reacting (i) an aromatic dicarboxylic acid or a dicarboxylic acid in which an aliphatic dicarboxylic acid is substituted for part of the aromatic dicarboxylic acid, and (ii) an aliphatic diol or an aromatic diol resin on a conductor having a copper surface without use of a solvent, and then heating the coated conductor in oxygen or an oxygen-containing gas at a temperature higher than the melting point of said linear polyester resin to permit cross-linking in the coated resin.

23 Claims, No Drawings

PROCESS FOR MANUFACTURING POLYESTER RESIN INSULATED WIRES

This is a continuation of application Ser. No. 204,474 filed Nov. 6, 1980, now abandoned.

The present invention relates to a process for manufacturing a wire insulated and coated with a polyester resin.

In recent years, it has been particularly desired in the manufacture of magnet wires insulated with polyester to provide a coating process, such as powder coating or molten coating, without use of any solvent in order to reduce pollution and save resources and energy.

A process has been proposed for manufacturing an insulated wire of enameled type by extruding a crystalline thermoplastic resin such as polyethylene terephthalate or the like (Japanese Patent Application Disclosure No. 4,875/78). However, a wire merely coated with an extrusion of such resin has been found to present various problems when used as a magnet wire.

The coating of a crystalline polymer tends to develop fine cracks, what is called "crazing", when elongated or bent during coil manufacture with resultant out deterioration of electrical properties. Further, the resin coating loses its flexibility due to crystallization when heated at a temperature below its melting points, for drying or other purposes.

Usaually, enameled wires are tested for resistance to heat deterioration by the methods specified in JIS (Japanese Industrial Standard) C 3203 (formal copper wire), C 3210 (polyester copper wire) and C 3211 (polyurethane copper wire) in which the flexibility of the wire is measured after heating for a predetermined period of time (for example, the winding properties of the polyester enameled wire after heating at 200° C. for 6 hours). Measurement by these methods revealed that said resin coating entirely lost its flexibility due to crystallization.

Furthermore, a wire which is extrusion coated with a polyester resin requires rapid cooling immediately after extrusion in order to avoid brittleness due to crystallization, and the coating thus formed does not meet chemical resistance requirements as will be presented hereinafter in comparative examples, so that it causes an extremely serious problem in its practical application as an insulated wire.

In order to improve the characteristics of polyester insulated wires formed by extrusion coating, it has been proposed that an electroconductive wire be coated with a polyester resin to a thickness of 100 μm or less and then heated at a temperature 10° to 50° C. higher than the glass transition point of the resin (Japanese Patent Publication No. 9,767/80). This thermal treatment lessens the problems related to thermal and electrical characteristics, such as degraded winding properties after heating of the resin coated wire, degraded heat shock properties and degraded dielectric strength resulting from a decrease in adhesion of the coating to the conductor due to residual stress generated in the resin coating at the time of extrusion. This method can be a solution to the above-mentioned problems; however, it cannot eliminate at all the defects attendant to a linear polyester resin, such as loss of flexibility of the coating, decreased crazing resistance and chemical resistance—all due to crystallization. This process also presents problems such as deterioration of various characteristics of the wire due to promotion of crystallization of the resin coating under some heating conditions.

As a result of extensive studies on processes for manufacturing polyester resin insulated wires having none of the defects stated above without using any solvents, it has now been found that a three-dimensional network may be formed in a resin coating by thermally treating, in oxygen or in a gas containing oxygen, a coating of a saturated substantially linear polyester resin on a copper conductor or a conductor having a copper layer at least covering the surface (both hereinafter called "the conductor") at a temperature higher than the melting point of the resin used. It is believed, although some points still remain unclear, that the heating of the linear polyester resin in the presence of oxygen at a temperature higher than the melting point of the resin causes a series of cross-linking reactions comprising the steps of oxidation of the resin, cleavage of the main chain, generation of free radicals and cross-linking between molecules. In this case, where the surface of the conductor is made of copper, it is assumed that the heating of a coating on the conductor at a temperature higher than the melting point of the resin immediately transfers copper ions from the conductor surface to the resin, and the presence of the copper ions permits cross-linking to proceed efficiently in the resin. Where the surface of the conductor is made of a metal other than copper, such as aluminum or the like, heating in the presence of oxygen can cause both oxidation of the resin and cleavage of the main chain, but it cannot produce the rest of the cross-linking reaction following the above two steps, so that the resulting low molecular weight products cause a considerable decrease in weight due to evaporation, sublimation or the like. Accordingly, the physical properties of the resulting resin coating cannot be used practically.

As a result of further studies based on the above knowledge, a process has been found in which a saturated substantially linear polyester resin is applied on the conductor, and then the coated conductor is heated at a temperature higher than the melting point of the resin coating on the conductor to cause a three-dimensional network in an amount (generally called the gel content) of at least 20% to provide a polyester resin insulated wire which has none of the above-mentioned problems, and permits processes such as coil winding or the like, and further has sufficient performance as a magnet wire.

The behavior which contributes to thermal cross-linking of the linear polyester resin is peculiar to copper, and is not found in any other metals. The presence of copper is a key point of the present invention.

The saturated substantially linear polyester resin referred to herein is intended to mean a polyester resin made mainly of an aromatic dicarboxylic acid or a dicarboxylic acid in which an aliphatic dicarboxylic acid is substituted for part of the aromatic dicarboxylic acid, and an aliphatic diol or an aromatic diol.

The aromatic dicarboxylic acid constituting the acid component of the linear polyester resin may include, for example, terephthalic acid, isophthalic acid, naphthalene dicarboxylic acid, diphenyl dicarboxylic acid, diphenyl sulfone dicarboxylic acid, diphenoxyethane dicarboxylic acid, diphenyl ether dicarboxylic acid, methyl terephthalate and, methyl isophthalate. Terephthalic acid and naphthalene dicarboxylic acid are particularly preferred. The aliphatic dicarboxylic acid such as succinic acid, adipic acid, sebacic acid may be included in an amount of 30 mol% or less, preferably 20 mol% or less, based on the amount of the aromatic dicarboxylic acid as the acid component.

The aliphatic diol constituting the dial component of the linear polyester resin may include, for example, ethylene glycol, propylene glycol, butylene glycol, hexane diol, decane diol. The aromatic diol may include, for example, 4,4'-dihydroxydiphenyl ether, bis(4-hydroxyphenyl)sulfide, bis(4-hydroxyphenyl)sulfone, bis(4-hydroxyphenyl)ketone, bis(4-hydroxyphenyl)methane, 1,1-bis(4-hydroxyphenyl)ethane, and 2,2-bis(4-hydroxyphenyl)propane. Ethylene glycol and butylene glycol are particularly preferred as the aliphatic diol and 2,2-bis(4-hydroxyphenyl)propane is preferred as the aromatic diol. A portion of the aliphatic diol may be replaced by an oxylalkylene glycol such as polyethylene glycol, polybutylene glycol.

Among the linear polyester resins made of the acid component and the diol component as stated hereinbefore, a general purpose resin having relatively favorable physical properties, such as polyethylene terephthalate, polybutylene terephthalate, polyethylene naphthalate, and poly-2,2-bisparaphenylenepropylidene terephthalate is preferred. Among them, polyethylene terephthalate is most preferred because it is inexpensive and has superior physical properties.

Processes for coating the above-stated linear polyester resin on a conductor without use of a solvent may include a process in which a molten resin is extruded to coat the conductor, or a process in which the conductor is immersed in a molten resin to be coated. These processes are most preferred from the economic point of view.

In the process of the present invention, oxygen is employed for oxidizing the resin and producing free radicals which can in turn contribute to the formation of cross-linking between the molecules. Accordingly, the process of the present invention requires the use of oxygen or an oxygen-containing gas as an essential element. Air is most often used because of its ready availability.

It is of great significance, from the viewpoint of industrial application and physical properties, that the elevation of the oxygen partial pressure in the oxygen-containing atmosphere to a level higher than the oxygen partial presence of air under normal conditions increases both the diffusion speed of the oxygen in the resin and the oxygen concentration in the resin, thereby improving the cross-linking speed and density. When the oxygen partial pressure is 230 mmHg or higher, these effects become remarkable. Although the upper limit of the oxygen partial pressure is not particularly restricted, 660 mmHg would be enough, considering the safety aspects.

Processes for elevating the oxygen partial pressure in the atmosphere may include, for example, a process in which a predetermined amount of oxygen is blown into a heating furnace at atmospheric pressure; a process in which an atmosphere is obtained by premixing oxygen and a gas such as nitrogen which is inert to the cross-linking reaction so as to raise the oxygen partial pressure to a level higher than the oxygen partial pressure in air under normal conditions; and a process in which the oxygen partial pressure of an oxygen-containing gas is made higher than that of air under normal conditions by applying pressure to the gas by means of a heating furnace capable of providing pressurized conditions.

As has been stated hereinabove, the process of the present invention requires the diffusion of oxygen in the resin. When the coated resin is too thick, a remarkable decrease in the diffusion speed of the oxygen into the resin is caused, and the cross-linking reaction is also slowed down. This remarkably degrades the physical properties resulting from the oxidation of the resin, so that the coating is preferably not thicker than 70 μm.

In accordance with the process of the present invention, the temperature at which the resin-coated conductor is heated is restricted to a temperature higher than the melting point of the resin for the following reasons: when the heating is carried out at a temperature lower than the melting point of the resin, the resin tends to crystalline, transfer of the copper ions into the resin becomes slow, and diffusion of oxygen into the resin is also slow so that a long period of time is required for providing a predetermined degree of cross-linking, and a high density of cross-linking is difficult to achieve.

It is also to be noted that elevating the temperature for heating the coated conductor accelerates the thermal decomposition reaction rather than the cross-linking speed to a remarkable extent, so that the physical properties of the resulting coating tend to be remarkably degraded. Accordingly, the temperature of the atmosphere in the heating furnace may be determined in consideration of the economics and the physical characteristics and is preferably 50° to 250° C. higher than the melting point of the coated resin.

The conductor wire to be used in the process of the present invention may include a wire at least covered by a copper layer such as a copper wire, an aluminum wire coated with copper. The wire used should allow the copper ions to migrate from the wire to the coated resin upon contact.

The gel content referred to in the present invention means the ratio of the weight of the undissolved materials to that of the original resin coating determined by dissolving the resin coating stripped off an insulated wire in m-cresol at 90° C. for 5 hours. This gel content is a measure of the degree of cross-linking of the resin.

The insulated wires generally show improved hardness, thermal softening properties, heat resistance, solvent resistance, and chemical resistance in proportion to the density of cross-linking in the resin, and the degree of cross-linking may be varied depending upon the physical properties required for each practical application.

An insulated wire made by the process of the present invention, if the gel content of its resin coating is lower than 20%, may not have characteristics required for a magnet wire, such as resistance to heat deterioration, solvent resistance, and chemical resistance. Therefore, the coating must have a gel content of 20% or higher. Polyester wires having an insulated coating with a gel content of 20 to 50%, made by the process of the present invention, are useful as insulated wires having superior solderability as represented by polyurethane wire. Polyester insulated wires having an insulated coating with a gel content higher than 50% are useful as insulated wires having superior properties with respect to hardness, heat resistance, solvent resistance and chemical resistance and the like, although they do not have suitability for soldering.

The following examples further illustrate the present invention.

EXAMPLE 1

A soft copper wire having a diameter of 0.85 mm was passed through a bath containing molten polyurethane terephthalate resin (trade name: TETRON TR 4550 BH; product of Teijin Limited; melting point, 250°–260° C.; intrinsic viscosity (in ortho-chlorphenol), 0.7; referred to hereinafter as PET) at 270° C. The wire was drawn from a die at the exit of the bath so as to form a coating having a thickness of 22 μm. The wire was then passed through an air atmosphere in a furnace having a length of 5 meters and kept at a furnace temperature of 450° C. at a speed of 5 m/min to provide an insulated wire. The resin coating was then removed from the insulated wire and measured for its gel content in the manner described hereinabove. The gel content was found to be 94.1%.

COMPARATIVE EXAMPLE 1

A soft copper wire having a diameter of 0.85 mm was passed through a bath containing the same molten PET as used in Example 1 at 270° C. It was drawn from a die so as to provide a coating having a thickness of 22 μm. The wire was cooled in water immediately thereafter. The resin coating was torn from the insulated wire and measured for the gel content, which was found to be 0%.

COMPARATIVE EXAMPLE 2

A soft copper wire having a diameter of 0.85 mm was coated with the same PET as used in Example 1 by extruding the molten PET on the wire so as to form a coating having a thickness of 22 μm. The resin coating was then measured for the gel content, which was found to be 0%.

EXAMPLE 2

The insulated wire made in Comparative Example 2 was passed at a rate of 5 m/min through a furnace having a length of 5 m and an air atmosphere at a temperature of 450° C.

The gel content of the resin coating on the above insulated wire was found to be 94.7%.

The resin coatings of the insulated wires made in Examples 1 and 2 and Comparative Examples 1 and 2 were subjected to differential thermal analysis (DTA). The tests indicated that the resin coatings of Comparative Examples 1 and 2 each gave an endothermic peak at about 255° C. due to melting, while those of Examples 1 and 2 gave no endothermic peak at this temperature. This presumes that some cross-linking occurred in the resin coating.

EXAMPLE 3

A copper wire having a diameter of 0.85 mm was passed through a bath which contained molten polyethylene terephthalate resin (trade name: TORAY PET RESIN J-055; product of Toray Limited; melting point, 255°–265° C.; intrinsic viscosity in ortho-chlorophenol at 25° C., 1.2–1.5) at 290° C. The wire was treated in the same manner as in Example 1 to provide an insulated wire. The gel content of the resin coating was found to be 97.3%.

The insulated wires made in Examples 1 to 3 and Comparative Examples 1 and 2 were measured for various performance characteristics according to the JIS C 3210. The results are shown in Table 1.

TABLE 1

| Characteristics | Example 1 | Example 2 | Comparative Example 1 | Comparative Example 2 | Example 3 | JIS C 3210 |
|---|---|---|---|---|---|---|
| Flexibility (wound around diameter of wire) | Good | Good | Good | Good | Good | Good |
| Resistance to deterioration (wound after 200° C. × 6 hrs) | 1× Good | 1× Good | 5× No Good | 5× No Good | 1× Good | 3× Good |
| Heat shock resistance (150° C. × 1 hr after wound) | 1× Good | 1× Good | 1× Good | 1× Good | 1× Good | 4× Good |
| Chemicals resistance (pencil hardness after immersed for 24 hrs at room temperature) | | | | | | |
| Sulfuric acid (specific gravity 1.2) | 4H | 3H | H | HB | 4H | Over 2H |
| Sodium hydroxide (1%) | 3H | 3H | H | HB | 3H | Over 2H |
| Scrape resistance (times, 440 g) | 33 | 34 | 16 | 22 | 44 | Over 25 |
| Dielectric breakdown voltage (KV) | 4.6 | 4.7 | 3.8 | 4.0 | 4.9 | Over 1.6 |
| Crazing resistance (number of pinholes after 3% elongation) | 1 | 2 | Many | Many | 0 | — |

EXAMPLE 4

A soft copper wire having a diameter of 0.85 mm was passed through a bath containing molten polybutylene terephthalate (melting point, 230°–235° C.; trade name: TOPPET N-1000; product of Toyobo K.K.; referred to hereinafter as PBT) at 240° C. The wire was treated in the same manner as in Example 1 to provide an insulated wire having a coating 25 μm thick. This wire was then heated in a baking furnace having a length of 5 meters and a temperature of 450° C. by passing at a speed of 5 m/min. The gel content of the resin coating was found to be 92.7%.

EXAMPLE 5 AND COMPARATIVE EXAMPLES 3 AND 4

A soft copper wire having a diameter of 0.85 mm was given a 23 μm-thick coating prepared by melting small pieces of polyethylene naphthalate films (melting point, 270°–275° C.; trade name: Q-film; product of Teijin Limited; referred to hereinafter as PEN) at 280° C. The wire was passed at a rate of 4 m/min through a baking furnace having a length of 5 meters and a temperature of 450° C. The gel content of the resin coating on the insulated wire was found to be 90%.

The insulated wires made in Examples 4 and 5 were tested for their various physical and chemical properties according to JIS C 3210. The results are shown in Table 3 below.

The results for insulated wires having coatings made by simply coating the molten PBT (Comparative Example 3) and PEN (Comparative Example 4) are given for comparison.

TABLE 2

| Characteristics* | Example 4 | Comparative Example 3 | Example 5 | Comparative Example 4 |
|---|---|---|---|---|
| Dielectric breakdown voltage (KV) | 4.5 | 3.2 | 4.8 | 3.6 |
| Resistance to deterioration | 2× Good | 5× No Good | 3× Good | 5× No Good |
| Chemicals resistance | | | | |
| Sulfuric acid | 4H | B | 5H | H |
| Sodium hydroxide | 3H | H | 4H | HB |
| Scrape resistance (times) | 28 | 15 | 37 | 20 |
| Crazing resistance (number of pinholes after 3% elongation) | 4 | Many | 1 | Many |

*Same to Table 1

EXAMPLES 6 THROUGH 8 AND COMPARATIVE EXAMPLE 5

The procedure of Example 1 was followed, except that the wires were subjected to the heat treatment in atmospheres containing oxygen in various amounts as illustrated in Table 3 below. The oxygen-containing gas introduced into the heating furnace was prepared by mixing oxygen with nitrogen so as to have a predetermined oxygen partial pressure.

The results for Comparative Example 5, in which the heating was conducted in a nitrogen atmosphere, are also shown in Table 3. The resin coating thickness was 22–25 μm in each case.

TABLE 3

| | | Example 6 | Example 7 | Example 8 | Comparative Example 5 |
|---|---|---|---|---|---|
| Conditions of manufacture | Furnace temperature (°C.) | 400 | 400 | 400 | 400 |
| | Passage speed (m/min) | 5 | 8 | 10 | 3 |
| | Furnace atmosphere (oxygen partial pressure mmHg) | 230 | 460 | 600 | In nitrogen |
| | Gel content (%) | 94.7 | 95.3 | 96.1 | 2.5 |
| Characteristics* | Flexibility | Good | Good | Good | Good |
| | Resistance to deterioration | 1× Good | 1× Good | 1× Good | 5× No Good |
| | Heat shock resistance | 1× Good | 1× Good | 1× Good | 1× Good |
| | Chemicals resistance | | | | |
| | Sulfuric acid | 4H | 5H | 5H | H |
| | Sodium hydroxide | 4H | 4H | 4H | HB |
| | Scrape resistance (times) | 37 | 40 | 42 | 17 |
| | Dielectric breakdown voltage (KV) | 4.5 | 4.4 | 4.6 | 4.2 |
| | Crazing resistance (number of pinholes after 3% elongation) | 0 | 1 | 1 | Many |

*Same to Table 1

It is apparent from Table 3 that the cross-linking speed increases with increase in oxygen partial pressure at the time of heating.

EXAMPLES 9 THROUGH 11 AND COMPARATIVE EXAMPLE 6

The same molten PET as used in Example 1 was applied on a soft copper wire having a diameter of 0.85 mm in the same manner as in Example 1. The resulting coated wire was then subjected to heat treatment in a baking furnace having a length of 5 meters under the conditions illustrated in Table 4 below, to provide an insulated wire. The thickness of the coating was 23–25 μm in each case.

For comparison, the procedure of Example 9 was followed except that the furnace temperature was 200° C. The performance characteristics of the insulated wire of Comparative Example 6 are shown in Table 4 below. When a heat treatment was conducted at 550° C., the flexibility of the coating was lost due to thermal decomposition of the coated resin of the wire, and no wire having satisfactory performance as a magnet wire was produced.

EXAMPLE 12 AND COMPARATIVE EXAMPLE 7

The procedure of Example 9 was followed with the exception that a copper clad aluminum wire of the same size was used in place of the copper wire. As Comparative Example 7, an aluminum wire having the same size as above was used. The results are shown in Table 4.

TABLE 4

| | | Example 9 | Example 10 | Example 11 | Comparative Example 6 | Example 12 | Comparative Example 7 |
|---|---|---|---|---|---|---|---|
| Conditions of manufacture | Furnace temperature (°C.) | 400 | 400 | 350 | 200 | 400 | 400 |
| | Passage speed (m/min) | 3 | 5 | 2 | 3 | 3 | 3 |
| | Furnace atmosphere | Air | Air | Air | Air | Air | Air |
| | Gel content (%) | 95.9 | 56.3 | 97.9 | 0 | 96.0 | 0 |
| Characteristics* | Flexibility | Good | Good | Good | Good | Good | Good |
| | Resistance to deterioration | 1× Good | 1× Good | 1× Good | 5× No Good | 1× Good | 5× No Good |
| | Heat shock resistance | 1× Good | 1× Good | 1× Good | 1× Good | 1× Good | 1× Good |
| | Chemicals resistance | | | | | | |
| | Sulfuric acid | 4H | 2H | 4H | HB | 3H | HB |
| | Sodium hydroxide | 3H | 2H | 3H | HB | 3H | HB |
| | Scrape resistance (times) | 35 | 29 | 38 | 14 | 39 | 21 |
| | Dielectric breakdown voltage (KV) | 6.5 | 7.5 | 7.3 | 3.9 | 5.8 | 3.5 |
| | Crazing resistance (number of pinholes after 3% elongation) | 0 | 2 | 0 | Many | 2 | Many |

*Same to Table 1

It is apparent from the above table that no improvements in performance were observed when the heating was carried out at a temperature below the melting point of the resin. When the surface of the wire was aluminum and not copper, the heating under the same conditions did not provide any gel content or any improvements in performance.

EXAMPLE 13 AND COMPARATIVE EXAMPLE 8

The same molten PET as used in Example 1 was coated on a soft copper wire having a diameter of 0.85 mm so as to form a coating having a thickness of 50 μm. The wire was then passed at a rate of 3 m/min through a baking furnace at 450° C. having an air atmosphere and a length of 5 meters. The resin coating of the resultant insulated wire had a gel content of 65.4%. As Comparative Example 8, the procedures of Example 13 was followed with the exception that the coating thickness was 75 μm and the wire was passed through the furnace at the rate of 2 m/min. The gel content of the resin coating on the insulated wire was found to be 17.5%. The results are shown in Table 5 below.

TABLE 5

| Characteristics* | Example 13 | Comparative Example 8 |
|---|---|---|
| Flexibility | Good | Good |
| resistance to deterioration | 1× Good | 5× No Good |
| Heat shock resistance | 1× Good | 1× Good |
| Chemicals resistance | | |
| Sulfuric acid | 3H | 2H |
| Sodium hydroxide | 3H | 2H |
| Scrape resistance (times) | 39 | 12 |
| Dielectric breakdown voltage (KV) | 10.3 | 13.7 |
| Crazing resistance (number of pinholes after 3% elongation) | 0 | Many |

*Same to Table 1

COMPARATIVE EXAMPLE 9

The same molten PET as used in Example 1 was extruded by means of a melting type extruder on a soft copper wire having a diameter of 0.5 mm so as to form a coating having a thickness of 18 μm. The gel content of the resin coating on the resulting insulated wire was found to be 0%.

EXAMPLES 14 THROUGH 17

The wires made in Comparative Example 9 were each heat treated in an air atmosphere in a furnace having a temperature of 450° C. and a length of 5 meters at a rate of 15 m/min, 20 m/min, 25 m/min and 30 m/min, respectively, to provide an insulated wire. The insulated wire was then tested for its various performance characteristics according to JIS C 3211 (polyurethane copper wire standard). The results are shown in Table 6 below.

TABLE 6

| Characteristics | Example 14 | Example 15 | Example 16 | Example 17 | Comparative Example 9 | JIS C 3211 |
|---|---|---|---|---|---|---|
| Gel content (%) | 94.1 | 58.6 | 46.0 | 27.0 | 0 | — |
| Flexibility | Good | Good | Good | Good | Good | Good |

TABLE 6-continued

| Characteristics | Example 14 | Example 15 | Example 16 | Example 17 | Comparative Example 9 | JIS C 3211 |
|---|---|---|---|---|---|---|
| (wound around diameter of wire) | | | | | | |
| Resistance to deterioration (wound after 170° C. × 6 hrs) | 1× Good | 1× Good | 2× Good | 3× Good | 5× No Good | 3× Good |
| Heat shock resistance (130° C. × 1 hr after wound) | 1× Good | 1× Good | 1× Good | 1× Good | 1× Good | 3× Good |
| Chemicals resistance (pencil hardness after immersed for 24 hrs at room temperature) | | | | | | |
| Sulfuric acid (specific gravity 1.2) | 4H | 3H | 3H | 3H | H | Over 2H |
| Sodium hydroxide (10%) | 3H | 3H | 3H | 2H | HB | Over 2H |
| Dielectric breakdown voltage (KV) | 4.3 | 4.3 | 4.4 | 4.1 | 4.1 | Over 1.4 |
| Solderability 380° C. (second) | Over 10 | 5 | 3 | 2 | 1 | 3 |

It is apparent from the above table that, when the gel content of the resin coating on the insulated wire is within the range of about 20 to 50%, solderability is good, so that application to a field requiring soldering is possible.

EXAMPLE 18 AND COMPARATIVE EXAMPLE 10

Poly-2,2-bisparaphenylenepropylidene terephthalate resin (trade name: U-polymer-U-4015); product of Unichika Co., Ltd.; specific gravity 1.24; referred to as U-polymer hereinafter) was extruded with a melting type extruder having a cylinder and die temperature of 310° C. over a copper wire of 0.85 mm diameter to form a resin coating to a thickness of 22 to 25 μm. The resin coated wire was passed at a rate of 5 m/min through a furnace having a length of 5 meters and an air atmosphere at a temperature of 470° C. to provide an insulated wire. The gel content of the resin coating of the insulated wire thus obtained was found to be 84.5%.

As Comparative Example 10, an insulated wire was made by simply extruding the U-polymer. The gel content of the resin coating was found to be 0%.

Various performance characteristics of the insulated wires obtained in Example 18 and Comparative Example 10 were tested according to JIS C 3210. The results are shown in Table 7.

TABLE 7

| Characteristics* | Example 18 | Comparative Example 10 |
|---|---|---|
| Dielectric breakdown voltage (KV) | 4.9 | 4.1 |
| Resistance to deterioration | 1× Good | 1× Good |
| Chemicals resistance | | |
| Sulfuric acid | 4H | H |
| Scrape resistance (times) | 39 | 24 |
| Crazing resistance (number of pinholes after 3% elongation) | 1 | Many |

*Same to Table 1

As is evident from the above examples, the process of the present invention can provide a magnet wire which has favorable characteristics and is inexpensive, saving resources and causing no pollution. The process is very valuable in industrial applications.

What we claim is:

1. A process for manufacturing a polyester resin insulated wire comprising coating a resin composition consisting essentially of a saturated substantially linear polyester resin prepared by reacting (i) an acid consisting essentially of an aromatic dicarboxylic acid or a dicarboxylic acid in which an aliphatic dicarboxylic acid is substituted for part of the aromatic dicarboxylic acid, and (ii) an alcohol consisting essentially of an aliphatic diol or an aromatic diol on a conductor having a copper surface without use of a solvent and heating the coated conductor in oxygen or an oxygen-containing gas at a temperature higher than the melting point of said linear polyester resin to cause cross-linking of said resin.

2. The process according to claim 1, wherein the saturated substantially linear polyester resin is polyethylene terephthalate.

3. A process according to claim 1, wherein the coating of the saturated substantially linear polyester resin on the conductor without use of a solvent is carried out by a method selected from extrusion coating and molten immersion coating.

4. The process according to claim 1, wherein the oxygen-containing gas has an oxygen partial pressure not lower than the oxygen partial pressure of air under normal conditions.

5. The process according to claim 4, wherein the oxygen-containing gas is air.

6. The process according to claim 4, wherein the oxygen partial pressure of the oxygen-containing gas is in the range of 230 mmHg to 600 mmHg.

7. The process according to claim 1 or 6, wherein heating of the resin-coated conductor is carried out in an atmosphere heated at 50° to 250° C. higher than the melting point of the polyester resin.

8. The process according to claim 1, wherein the conductor is copper wire.

9. The process according to claim 1, wherein the conductor is aluminum wire coated with copper.

10. The process according to claim 1 or 6, wherein the thickness of the coating of the resin-coated conductor is not more than 70 μm.

11. The process according to claim 1 or 6, wherein the the heating is carried out to cause cross-linking so that the amount of residual undissolved materials is in the range of 20 to 50% by weight when the coated resin is immersed in m-cresol at 90° C. for 5 hours.

12. The process according to claim 1 or 6, wherein heating is carried out to cause cross-linking so that the amount of residual undissolved materials is more than 50% by weight when the coated resin is immersed in m-cresol at 90° C. for 5 hours.

13. The process according to claim 7 wherein the thickness of the coating of the resin-coated conductor is not more than 70 μm.

14. The process according to claim 13, wherein the heating is carried out to cause cross-linking so that the amount of residual undissolved materials is in the range of 20 to 50% by weight when the coated resin is immersed in m-cresol at 90° C. for 5 hours.

15. The process according to claim 13, wherein the heating is carried out to cause cross-linking so that the amount of residual undissolved materials is more than 50% by weight when the coated resin is immersed in m-cresol at 90° C. for 5 hours.

16. A process for manufacturing a polyester resin insulated wire comprising coating a resin composition consisting essentially of a polyester resin selected from the group consisting of polyethylene terephthalate, polybutylene terephthalate, polyethylene naphthalate and poly-2,2-bisparaphenylenepropylidene terephthalate on a conductor having a copper surface without the use of a solvent and heating the coated conductor in oxygen or an oxygen-containing gas at a temperature higher than the melting point of said resin to cause cross-linking of said resin.

17. The process according to claim 16, wherein the polyester resin is polyethylene terephthalate.

18. The process of claim 16, wherein the oxygen-containing gas has an oxygen partial pressure not lower than the oxygen partial pressure of air under normal conditions.

19. The process of claim 18, wherein the oxygen partial pressure of the oxygen-containing gas is in the range of 230 mmHg to 600 mmHg.

20. The process of claim 19, wherein heating of the resin-coated conductor is carried out in an atmosphere heated at 50° to 250° C. higher than the melting point of the polyester resin.

21. The process of claim 19, wherein the thickness of the coating of the resin-coated conductor is not more than 70 μm.

22. The process of claim 16, wherein heating is carried out to cause cross-linking so that the amount of residual undissolved materials is in the range of 20 to 50% by weight when the coated resin is immersed in m-cresol at 90° C. for 5 hours.

23. The process of claim 16, wherein heating is carried out to cause cross-linking so that the amount of residual undissolved materials is more than 50% by weight when the coated resin is immersed in m-cresol at 90° C. for 5 hours.

* * * * *